US011319767B2

(12) United States Patent
Mackie

(10) Patent No.: US 11,319,767 B2
(45) Date of Patent: May 3, 2022

(54) TENSION ARRANGEMENT FOR SUBSEA CHRISTMAS TREE

(71) Applicant: Expro North Sea Limited, Aberdeen (GB)

(72) Inventor: David Hird Mackie, Westhill (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 16/647,360

(22) PCT Filed: Sep. 14, 2018

(86) PCT No.: PCT/GB2018/052634
§ 371 (c)(1),
(2) Date: Mar. 13, 2020

(87) PCT Pub. No.: WO2019/053459
PCT Pub. Date: Mar. 21, 2019

(65) Prior Publication Data

US 2021/0025257 A1 Jan. 28, 2021

(30) Foreign Application Priority Data

Sep. 15, 2017 (GB) ..... 1714903

(51) Int. Cl.
*E21B 33/035* (2006.01)
*E21B 47/001* (2012.01)
*E21B 41/00* (2006.01)

(52) U.S. Cl.
CPC ..... *E21B 33/035* (2013.01); *E21B 41/0007* (2013.01); *E21B 47/001* (2020.05)

(58) Field of Classification Search
CPC ..... E02D 5/54; E21B 33/064; E21B 33/038; E21B 41/08; E21B 33/0355; E21B 33/043; E21B 43/0135; E21B 33/035; E21B 47/001; E21B 41/0007
See application file for complete search history.

(56) References Cited

U.S. PATENT DOCUMENTS 3,532,162 A * 10/1970 Fischer ..... E21B 33/035 166/360
3,934,658 A * 1/1976 Nelson ..... E21B 7/128 175/7
2014/0374115 A1* 12/2014 Kebadze ..... E21B 41/0007 166/345
2018/0003008 A1 1/2018 Osen

FOREIGN PATENT DOCUMENTS

WO 2017155415 A1 9/2017
WO WO-2017155415 A1 * 9/2017 ..... E21B 33/038

* cited by examiner

*Primary Examiner* — James G Sayre
(74) *Attorney, Agent, or Firm* — Getz Balich LLC

(57) ABSTRACT

The present disclosure describes a subsea well installation including an Xmas tree coupled to a wellhead. A guide frame is located at a lower region of the Xmas tree. A flush and cap tool (FACT) adaptor is mounted on an upper region of the Xmas tree. A tension arrangement extends between the guide frame and the FACT adaptor, to apply a compressive force through the Xmas tree.

16 Claims, 2 Drawing Sheets

TENSION ARRANGEMENT FOR SUBSEA CHRISTMAS TREE

This application claims priority to PCT Patent Appln. No. PCT/GB2018/052634 filed Sep. 14, 2018, which claims priority GB Patent Appln. No. 1714903.0 filed Sep. 15, 2017, which are herein incorporated by reference.

BACKGROUND OF THE INVENTION

1. Technical Field

Disclosed examples relate to a subsea wellhead installation, and associated methods.

2. Background Information

Aging subsea infrastructure, such as subsea Christmas (Xmas) trees, may be at risk of becoming compromised, for example by accidental collision (e.g., from fishing activities), during performance of intervention or workover operations, such as a well plugging and abandonment (P&A), or the like. The age and design of such well infrastructure may complicate certain operations and/or present an environmental risk in that the well may not retain sufficient sealing integrity should the Xmas tree sustain any damage. This may permit uncontrolled flow of well fluids into the environment. There is also a risk that due to non-use over time, the operation of the valves in the Xmas tree may be compromised, such that the ability to rely on the Xmas tree valves to reseal a well may not be possible, for example after the valves are opened to perform an intervention operation, such as a P&A operation which may not prove initially successful.

Before carrying out an intervention or P&A operation, a well control package such as a blowout preventer (BOP) may be installed on an existing well installation, for example using a landing string or riser, so as to provide required well control while the well is accessed. The weight of modern well control packages (e.g., BOPs) as well as the forces involved while carrying out intervention or P&A operations may be a cause for concern for some existing well installations due to the possibility of components of the well installation being subject to accelerated fatigue, adverse lateral bending moments, adverse tensile forces, and the like, which may affect the integrity of the existing well installation. For example, there may be a risk of flanges within the existing well installation becoming separated due to operational loads.

SUMMARY OF THE INVENTION

A first aspect or example of the present disclosure relates to a subsea well installation. The subsea well installation may comprise a Xmas tree coupled to a wellhead. The subsea well installation may comprise a base structure located at a lower region of the Xmas tree. The subsea well installation may comprise a subsea package mounted on an upper region of the Xmas tree. The subsea well installation may comprise a tension arrangement extending between the base structure and the subsea package. The tension arrangement may apply a compressive force through the Xmas tree.

In use, the subsea package may be mounted on the Xmas tree for performing an intervention or plugging and abandonment (P&A) operation. The subsea package may comprise a well control package, which may provide, for example, BOP functionality. During installation, the subsea package may be landed on the Xmas tree using a riser or a landing string. The subsea package may be relatively heavy, which may introduce significant loading through the Xmas tree. During operations, such as intervention or P&A operations, bending loads, impulses, and any other loads applied to the Xmas tree (for example via a connected landing string or the like, from jarring operations and the like), may cause structural problems, such as stress, fatigue, strain, deformation, and the like in the Xmas tree. There may also be a risk that some components such as tree flanges may separate, for example.

The tension arrangement may at least partially compensate for the loading experienced by the Xmas tree, for example, during intervention or P&A operations, and the like. Applying the compressive force through the Xmas tree may reduce the likelihood of components of the Xmas tree separating e.g. during a jarring operation, or the like.

The tension arrangement may reduce or remove the need for running conventional frame based designs for supporting the subsea package, which may reduce installation time and/or operational costs. Providing a tension arrangement for the subsea well installation may reduce the potential risk of enduring increased fatigue damage or wear on aging subsea infrastructure during operations such as intervention or P&A operation. It will however be appreciated that while aspects or examples of the present disclosure may be used in connection with aging subsea infrastructure, aspects or examples of the present disclosure may also be used in connection with newer or modern subsea infrastructure. It will also be appreciated that while aspects or examples of the present disclosure may be used in connection with operations such as intervention and P&A operations, aspects or examples of the present disclosure may also be used in connection with other operations such as completion and production operations, and the like. For example, at least one part of the tension arrangement may be initially deployed with the Xmas tree or installed on the Xmas tree at some point during the lifetime of the well.

The Xmas tree may define an axial length between the base structure and the subsea package. The tension arrangement may extend across at least that axial length, to apply the compressive force through the axial length of Xmas tree.

The tension arrangement may comprise at least one tensioning member extending across at least the axial length.

The subsea well installation may comprise a first mounting arrangement for connecting the tension arrangement to the upper region of the Xmas tree. The subsea well installation may comprise a second mounting arrangement for connecting the tension arrangement to the lower region of the Xmas tree.

The first mounting arrangement may be axially proximal to the subsea package. The first mounting arrangement may be axially distal to the wellhead. The second mounting arrangement may be axially proximal to the wellhead. The second mounting arrangement may be axially distal to the subsea package.

The first mounting arrangement may be connectable to or provided as part of the subsea package.

The first mounting arrangement may be connectable to or provided as part of an adaptor sub or interface sub provided as part of or connectable to the subsea package.

The second mounting arrangement may be connectable to or provided as part of the base structure.

The base structure may be mounted to the wellhead.

The base structure may be supported relative to a seabed by the wellhead.

The base structure may be mounted to, and supported relative to a seabed by, the wellhead itself such that a part of the tension arrangement associated with the base structure may be fixed relative to the wellhead.

The tension arrangement may comprise at least one tensioning member.

The at least one tensioning member may extend between the subsea package and the base structure.

The base structure may be locatable or located at a lower region of the Xmas tree.

The at least one tensioning member may comprise: a wire, cable, rope, bar, rod, or the like.

The tensioning member may comprise or be made from any material suitable for resisting or compensating for loading experienced by the subsea well installation during an intervention or P&A operation. The tensioning member may comprise metal, steel, metal alloy, or the like.

The at least one tensioning member may comprise at least one of: a flexible material and a rigid material.

The at least one tensioning member may be mounted on the subsea package with a first mounting arrangement.

The subsea package may comprise or be connectable to an adaptor sub or interface sub, or the like. The adaptor sub or interface sub may comprise a connection profile for latching onto the Xmas tree. The connection profile may comprise a flange, or the like. The tension arrangement may extend between the adaptor sub or interface sub and the base structure. The tension arrangement may apply a compressive force through the Xmas tree between the subsea package, adaptor sub or interface sub, or the like and the base structure.

The subsea package may comprise an auxiliary tree block (ATB) for connecting the Xmas tree to a rig, intervention vehicle, light well intervention vehicle (LWIV), or the like, via a running string, landing string, riser, or the like. The subsea package may comprise a flush and cap tool (FACT) adaptor, such as provided by the applicant of the present disclosure. The ATB may comprise or be in the form of the FACT adaptor. The FACT adaptor may comprise or be connectable to a landing string or riser. The FACT adaptor may comprise or be connectable to the Xmas tree or another well installation. The FACT adaptor may comprise an adaptor sub or interface sub for connecting the FACT adaptor to the Xmas tree or another well installation.

The FACT adaptor may be configured to provide well control (e.g., BOP) functionality or to replace the well control functionality of a pre-existing system provided with the Xmas tree. The FACT adaptor may comprise at least one valve for closing at least one of: a main bore; and an annulus bore of the FACT adaptor. The at least one valve may be configured to cut either wireline or coiled tubing, or the like, if required. The FACT adaptor may be installed on the Xmas tree either temporarily or permanently. The FACT adaptor may be configured to at least one of: provide access to the well, provide functionality to perform well intervention; perform flushing and fluid displacement operations; and setting of plugs for suspending the well.

The subsea package may be configured to support an intervention operation, for example a P&A operation. The subsea package may be configured to provide well control functionality e.g. for closing off at least one bore (e.g., main bore, annulus bore or the like) of the subsea package so as to isolate the well either temporarily or permanently. The subsea package may be left in place on the Xmas tree once installed, e.g. to provide continuing well control functionality. It will be appreciated that the subsea package may comprise any appropriate well control package, which may provide the same, similar or different functionality to that of the FACT adaptor, or the like.

The tension arrangement may comprise a first mounting arrangement. The first mounting arrangement may comprise or be in the form of at least one pad eye, or any other mounting structure. The first mounting arrangement or at least one mounting structure may be mounted between the Xmas tree and the subsea package. The first mounting arrangement or at least one mounting structure may be mounted on a coupling block for coupling the subsea package to the Xmas tree. The first mounting arrangement or the at least one mounting structure may be spaced apart from each other, for example, circumferentially around the coupling block.

The at least one tensioning member may be mounted on the base structure with a second mounting arrangement.

The tension arrangement may comprise a second mounting arrangement. The second mounting arrangement may comprise or be in the form of at least one tension support member. The second mounting arrangement may be mounted on the base structure. The second mounting arrangement may be mounted to the base structure using any appropriate method. The second mounting arrangement or the at least one tension support member may be spaced apart from each other, for example, circumferentially around the guide frame. The tension support member may form an integral part of the base structure and/or may comprise separate components for mounting on the base structure during installation.

There may be more than one first mounting arrangement or other mounting structure, e.g. mounted on the subsea package. There may be more than one second mounting arrangement, tension support member, or the like, e.g. mounted on the base structure. One or more tensioning members may be mounted on or attached to the first mounting arrangement and/or the second mounting arrangement. One or more tensioning members may extend between the first mounting arrangement and the second mounting arrangement.

The second mounting arrangement may be arranged to define a tensioning member angle of the at least one tensioning member for resisting or compensating for horizontal or bending forces applied to the Xmas tree.

The second mounting arrangement may comprise a bracket or an extended bracket. The bracket or extended bracket may be positioned so that the second mounting arrangement may be spaced (e.g. horizontally) away from the Xmas tree so as to define a tensioning member angle for increasing the resistance or compensation for horizontal or bending forces applied to the Xmas tree (e.g. compared with if the second mounting arrangement is spaced (e.g. horizontally) nearer to the Xmas tree). The Xmas tree may be configured to define a vertical direction, e.g. the Xmas tree may be generally vertical with respect to the wellhead.

The tension arrangement may comprise a tension adjuster for controlling the compressive force through the Xmas tree.

The tension adjuster may comprise any appropriate adjustment device for varying tension in the at least one tensioning member. The tension adjuster may comprise a length adjustment device for varying the length of the at least one tension adjuster. The tension adjuster may comprise a turnbuckle. The tension adjuster may comprise a winch, ratchet winch, or the like. The tension adjuster may comprise any appropriate device for controlling or varying tension in the at least one tensioning member. The tension adjuster may be disposed at an end of the at least one tensioning member. The tensioning adjuster may be disposed within or along the at least one tensioning member. In an example the tension adjuster may be or comprise a turnbuckle and the at least one tensioning member may be or comprise a cable, wire, or the like. The turnbuckle may be configured for varying the tension in the tensioning member.

The subsea well installation may comprise a tension monitor for monitoring tension or loading in at least one of: the tension arrangement; and the Xmas tree.

The tension monitor may comprise a strain gauge, load cell, or the like for monitoring tension in the at least one tensioning member and/or loading across the Xmas tree. The tension monitor may be provided as part of any component of the installation, for example, as part of at least one of: the tension adjuster; the first mounting arrangement; the second mounting arrangement; the tensioning member; and the like. An installer/operator may use the tension monitor for determining whether or how to vary tension in one or more tensioning member and/or loading across the Xmas tree, for example, to provide an even or balanced compressive force through the Xmas tree. At least one tension monitor may be provided for determining tension in the tension arrangement. At least one tension monitor may be provided for determining loading across the Xmas tree.

A second aspect or example of the present disclosure relates to a method for supporting a subsea well installation. The subsea well installation may comprise a Xmas tree coupled to a wellhead and a base structure located at a lower region of the Xmas tree. The method may comprise providing a tension arrangement between the base structure and a subsea package mounted on an upper region of the Xmas tree. The tension arrangement may apply a compressive force through the Xmas tree.

The tension arrangement may at least partially compensate for the loading experienced by the Xmas tree, for example, during intervention or P&A operations, and the like. Applying the compressive force through the Xmas tree may reduce the likelihood of components of the Xmas tree separating, breaking, or otherwise degrading. The tension arrangement may be provided for an existing subsea well installation, or may be provided as part of a subsea well installation for installation on the wellhead. The method may comprise mounting the subsea package on the Xmas tree and providing the tension arrangement between the base structure and the subsea package, or the method may comprise providing the tension arrangement between the base structure and a previously installed subsea package.

The method may comprise applying tension between the subsea package and the base structure.

Providing the tension arrangement may comprise providing at least one tensioning member extending between the subsea package and the base structure.

The method may comprise at least one of: mounting the at least one tensioning member on the subsea package; and mounting the at least one tensioning member on an adaptor sub or interface sub for connecting the subsea package to the Xmas tree.

The method may comprise mounting the at least one tensioning member on the subsea package and/or the adaptor sub or interface sub with a first mounting arrangement.

The method may comprise mounting the at least one tensioning member on the base structure.

The method may comprise mounting the at least one tensioning member on the base structure with a second mounting arrangement.

The method may comprise controlling or varying tension in the tension arrangement to control compressive force applied through the Xmas tree.

The method may comprise monitoring tension or loading in at least one of: the tension arrangement; and the Xmas tree.

Monitoring loading in the Xmas tree may be determined using the tension monitored in the tension arrangement. At least one tension measurement in at least one part of the tension arrangement may be used to determine tension in at least one tensioning member and/or be indicative of a loading in the Xmas tree. For example, if a tension measurement is higher on one side of the Xmas tree than another side of the Xmas tree, this may indicate that the Xmas tree is experiencing a bending moment. Thus, an operator may take action to compensate for the bending moment, for example, by suspending well operations, altering operations, changing the tension in at least one tensioning member of the tension arrangement, or the like.

The method may comprise using the monitored tension or loading to determine the compressive force acting through the Xmas tree.

The method may comprise varying tension in the tension arrangement in response to a tension value registered during monitoring of the tension or loading in at least one of: the tension arrangement; and the Xmas tree.

The method may comprise controlling movement of the subsea package relative to the Xmas tree in response to a tension value registered during monitoring of the tension or loading in at least one of: the tension arrangement; and the Xmas tree.

The method may comprise using a feedback system to actively control or vary tension in the tension arrangement to control a compressive force being applied through the Xmas tree, and/or to reduce fatigue, lateral bending moments, adverse tensile forces, and the like, affecting the integrity of the subsea well installation.

The method may comprise mounting the subsea package on the upper region of the Xmas tree.

The method may comprise initially mounting the subsea package on the upper region of the Xmas tree, for example, on a previously installed Xmas tree. The method may comprise subsequently providing a tension arrangement between the base structure and the subsea package.

The method may comprise running the subsea package via a subsea-surface connector to the Xmas tree.

The method may comprise providing the tension arrangement subsequent to mounting the subsea package on the Xmas tree.

The method may comprise providing an assembly comprising: the Xmas tree; the subsea package; and the tension arrangement between a base structure of the Xmas tree and the subsea package. The method may comprise running the assembly via a subsea-surface connector to the wellhead. The method may comprise installing the assembly on the wellhead.

The subsea-surface connector may comprise at least one of: a running string, landing string, riser, and the like.

The method may comprise performing an operation on a well that is accessible via the wellhead.

The operation may comprise a single operation or a number of operations.

The method may comprise accessing the well, via the subsea package, to perform the operation.

The operation may comprise at least one of: a completion; production; intervention; and plugging and abandonment operation.

The tension arrangement may be used in connection with any appropriate operation.

The method may comprise using the subsea package for at least part of the operation.

The method may comprise leaving the subsea package in place after the operation.

The method may comprise removing the subsea package after the operation.

A third aspect or example of the present disclosure relates to a method of performing an operation on a well that is accessible via a Xmas tree coupled to a wellhead of the well. The method may comprise providing a tension arrangement between a base structure at a lower end region of the Xmas tree and a subsea package mounted on an upper region of the Xmas tree, to apply a compressive force through the Xmas tree. The method may comprise accessing the well to perform the operation.

The method may be used as part of any well operation, for example, as part of completion, production, intervention, plugging and abandonment operation, or the like. The tension arrangement may be used to provide support for the Xmas tree, which may be part of a subsea well installation. The method may permit access to the well via the Xmas tree to perform the operation. The method may provide support for the Xmas tree while the operation is being performed, for example, to at least partially compensate for the loading experienced by the Xmas tree, for example, during any stage of the operation. Applying the compressive force through the Xmas tree may reduce the likelihood of components of the Xmas tree separating, breaking, or otherwise degrading.

The method may comprise mounting the subsea package on the Xmas tree.

The method may comprise initially mounting the subsea package on the upper region of the Xmas tree, for example, on a previously installed Xmas tree. The method may comprise subsequently providing the tension arrangement between a base structure of the Xmas tree and the subsea package.

The method may comprise running the subsea package via a subsea-surface connector to the Xmas tree.

The method may comprise providing the tension arrangement subsequent to mounting the subsea package on the Xmas tree.

The method may comprise providing an assembly comprising: the Xmas tree; the subsea package; and the tension arrangement between a base structure of the Xmas tree and the subsea package. The method may comprise running the assembly via a subsea-surface connector to the wellhead. The method may comprise installing the assembly on the wellhead.

The subsea-surface connector may comprise at least one of: a running string; landing string; riser; and the like.

The method may comprise accessing the well, via the subsea package, to perform the operation.

The method may comprise using the subsea package for at least part of the operation.

The method may comprise leaving the subsea package in place after the operation.

The method may comprise removing the subsea package after the operation.

A fourth aspect or example of the present disclosure relates to a method for installing a well installation comprising an Xmas tree. The method may comprise mounting a subsea package on an upper region of the Xmas tree. The method may comprise providing a tension arrangement between the subsea package and a base structure located at a lower region of the Xmas tree, to apply a compressive force through the Xmas tree.

The method may comprise providing an assembly comprising: the Xmas tree; the subsea package; and the tension arrangement. The method may comprise running the assembly via a subsea-surface connector to a wellhead. The method may comprise installing the assembly on the wellhead.

A fifth aspect or example of the present disclosure relates to a method for performing an operation on a well that is accessible via an Xmas tree coupled to a wellhead of the well. The Xmas tree may be configured to be supported by a tension arrangement provided between a base structure at a lower end region of the Xmas tree and a subsea package mounted on an upper region of the Xmas tree. The method may comprise using the tension arrangement to apply a compressive force through the Xmas tree. The method may comprise accessing the well to perform the operation.

At least one feature of the method according to the second, third, fourth and fifth aspects or examples may equally be applicable for use in conjunction with, replace, or be combined with at least one feature of the method according to any other of the second, third, fourth and fifth aspects or examples. Further, at least one feature of the apparatus according to the first aspect or example may equally be applicable for use in conjunction with, replace, or be combined with at least one feature of the method according to the second, third, fourth and/or fifth aspects or examples, or vice versa.

At least one feature of any example, aspect or embodiment of the present disclosure may replace any corresponding feature of any example, aspect or embodiment of the present disclosure. At least one feature of any example, aspect or embodiment of the present disclosure may be combined with any other example, aspect or embodiment of the present disclosure.

BRIEF DESCRIPTION OF THE DRAWINGS

These and other aspects or examples of the present disclosure will now be described with reference to the accompanying drawings, in which.

DETAILED DESCRIPTION OF THE INVENTION

Figure 1:
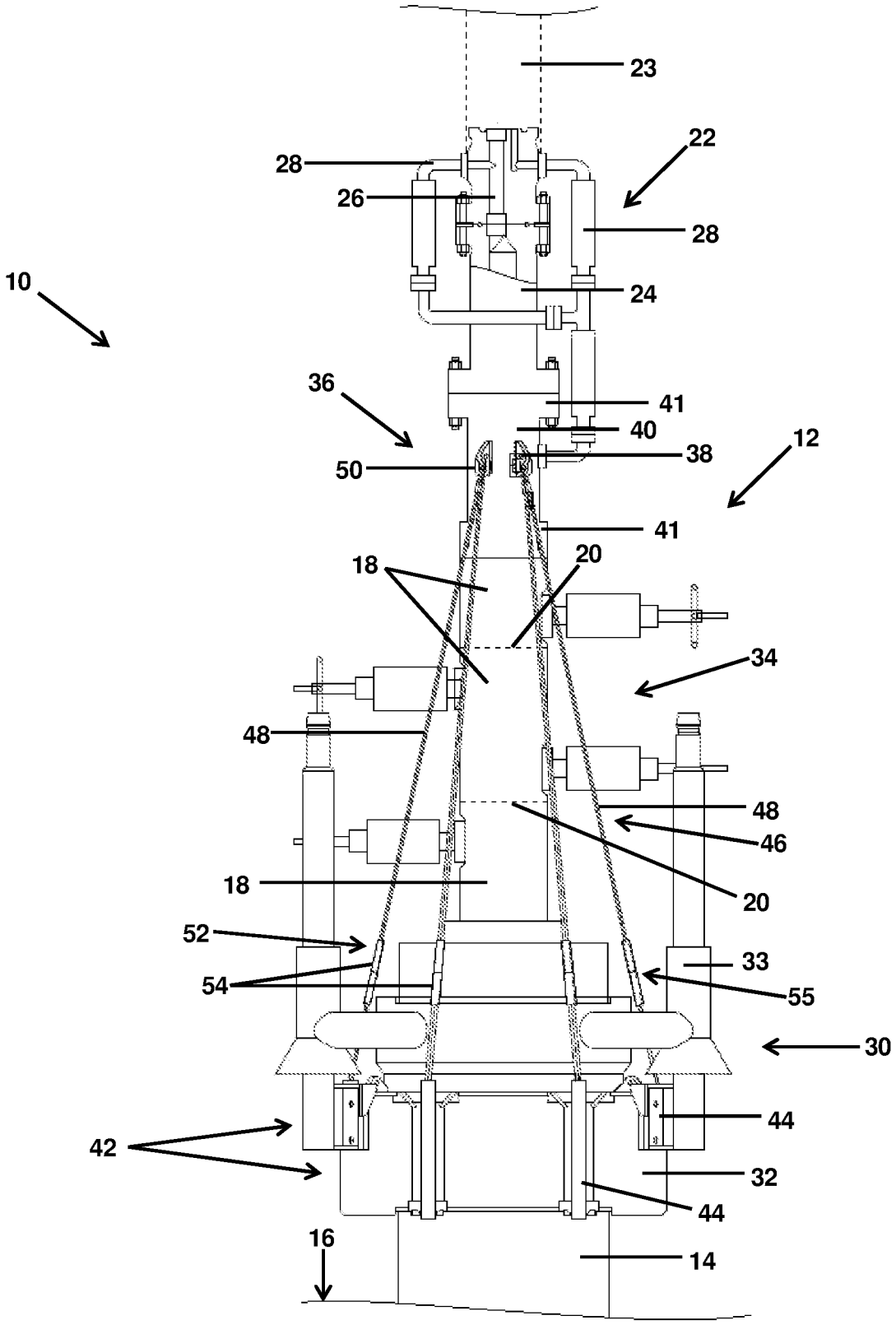
FIG. 1 illustrates a side view of a subsea well installation including a tension arrangement according to an example of the present disclosure.

Referring initially to FIG. 1, there is illustrated a subsea well installation 10 including a production or Christmas (Xmas) tree 12 connected to a wellhead 14 for a well (not shown) which extends below a seabed 16. The subsea well installation 10 may require some form of intervention, for example to plug and abandon (P&A) the well. In this example, the subsea well installation 10 has a number of structural features, which due to their design and/or age, may cause issues during such an intervention operation.

FIG. 1 is a schematic representation of a subsea well installation 10. In some circumstances, for example where the installation 10 has been deployed for a significant time period, the well installation 10 may suffer from integrity concerns, and may not be able to support the loads generated during an intervention operation, or at best, the operation may accelerate the fatigue at the subsea well installation 10 to undesirable levels.

The Xmas tree 12 includes a number of components such as valve blocks 18. The connection between the valve blocks 18 may be at risk of degrading or separating if excessive loading is applied to the Xmas tree 12. In the present example, a number of tree flanges 20 are represented by several dashed lines 20 which connect adjacent valve blocks 18.

If it is desired to perform an intervention operation, a subsea package 22 is lowered onto the Xmas tree 12 using a subsea-surface connector 23 deployed from a rig or other vehicle (not shown). The subsea-surface connector 23 may include a riser, running string, landing string, or the like. In this example, the subsea package 22 includes a flush and cap tool (FACT) adaptor 24, such as provided by the applicant of the present disclosure. However, a person of ordinary skill in the art will appreciate that the subsea package 22 could take any appropriate form and/or have any appropriate functionality for performing intervention or P&A operations, including, for example, well control (e.g., BOP) functionality for closing off at least one bore of the subsea package 22 so as to isolate the associated well either temporarily or permanently.

The FACT adaptor 24 provides an operator with the capability to access the well (not shown) via the Xmas tree 12 and wellhead 14, while providing the functionality for at least one of: performing well intervention operations; flushing and fluid displacement (e.g. lubrication) operations; setting plugs for suspending the well; and any other intervention or P&A operations.

The FACT adaptor 24 includes a number of valves (not shown) e.g. for opening or closing off a main bore 26 and/or an annulus bore 28 of the FACT adaptor 24. The FACT adaptor 24 may be used for at least one of: providing a required route for any fluids e.g. in an intervention or P&A operation; cutting wireline or coil tubing, or the like, if required; and permanently or temporarily suspending the well if required. If for any reason well integrity cannot be established during an operation, then the appropriate valves of the FACT adaptor 24 can be closed permanently or at least until the operator can establish an appropriate course of action. The FACT adaptor 24 also includes plug setting profiles (not shown) for allowing crown plugs (not shown) to be set as required.

A base structure, which in this example is in the form of a guide frame 30, is located at a lower region of the Xmas tree 12, on or around the wellhead 14. The guide frame 30 includes a guide base 32 for mounting to the wellhead 14 and guide posts 33 which may be used to assist with aligning components of the subsea well installation 10 relative to the wellhead 14 (e.g. during initial installation of Xmas tree 12, during running of the FACT adaptor 24, etc.).

The subsea well installation 10 further includes a tension arrangement 34 for applying a compressive force through the Xmas tree 12 between the guide frame 30 and the FACT adaptor 24. The Xmas tree 12 defines an axial length between the base structure (i.e. guide frame 30) and the subsea package 22. The tension arrangement 34 extends across at least that axial length, to apply the compressive force through the axial length of Xmas tree 12.

The tension arrangement 34 includes a first mounting arrangement 36, which in this example is in the form of a number of pad eyes 38 mounted (e.g. by welding or another attachment method) on an adaptor sub 40 which connects the FACT adaptor 24 to the Xmas tree 12. The first mounting arrangement 36 is axially proximal to the subsea package 22 and axially distal to the wellhead 14. In other words, the first mounting arrangement 36 is axially closer to the subsea package 22 than the wellhead 14 with respect to a vertical axis defined by the Xmas tree 12 and subsea-surface connector 23. The adaptor sub 40 may provide functionality in ensuring appropriate connection and interfacing with the type of Xmas tree 12. The pad eyes 38 are spaced apart from each other circumferentially around the adaptor sub 40. In this example the FACT adaptor 24 is connected to the adaptor sub 40, which includes a flange 41 at each end thereof for connecting the adaptor sub 40 to the FACT adaptor 24 and Xmas tree 12 respectively. In this example, the tension arrangement 34 extends between the adaptor sub 40 and the guide frame 30 so that the tension arrangement 34 can apply a compressive force through the Xmas tree 12 between the FACT adaptor 24 and the guide frame 30. It will be appreciated that adaptor sub 40 may be provided as a separate component to the FACT adaptor 24, or may be provided as an integral part of the FACT adaptor 24, or the like.

The tension arrangement 34 also includes a second mounting arrangement 42 in the form of a number of tension support members 44 mounted on the guide frame 30. The tension support members 44 are mounted (e.g. by welding or another attachment method) to the guide frame 30. The tension support members 44 are spaced apart from each other circumferentially around the guide frame 30. The second mounting arrangement 42 is axially proximal to the wellhead 14 and axially distal to the subsea package 22. In other words, the second mounting arrangement 42 is axially closer to the wellhead 14 than the subsea package 22 with respect to the vertical axis defined by the Xmas tree 12 and subsea-surface connector 23.

The tension arrangement 34 includes a number of tensioning members 46 in the form of cables 48 extending between the pad eyes 38 of the first mounting arrangement 36 and the tension support members 44 of the second mounting arrangement 42. In this example, each pad eye 38 is connected to two cables 46 via a cable coupling 50 (e.g. a loop, ring, carabiner, or the like). Each of the two cables 48 are connected to two separate, spaced-apart, tension support members 44 of the second mounting arrangement 42 such that there are twice as many tension support members 44 as there are pad eyes 38.

The cables 48 each include a tension adjuster 52 in the form of a turnbuckle 54 for varying the tension in the cable 48. If there is tension in the cable 48 between the first and second mounting arrangements 36, 42, a compressive force is applied through the Xmas tree 12. By appropriately positioning the first and second mounting arrangements 36, 42 around the subsea well installation 10, the cables 36 can be used to compensate for bending loads applied to the Xmas tree 12 as well as providing a compressive force through the Xmas tree 12 for helping to maintain the integrity of the Xmas tree 12 and preventing structural damage to or separation of the components of the Xmas tree 12.

The tension arrangement 34 can be readily installed between the first and second mounting arrangements 36, 42. For example, the pad eyes 38 and the tension support members 44 can be attached to the subsea well installation 10 using any appropriate method. An installer, such as a diver, remotely operated vehicle, autonomously operated vehicle or the like can then install the cables 48 between the appropriate pad eyes 38 and the tension support members 44 in an initially relaxed state and subsequently increase the tension in the cables 48 by actuating each of the turnbuckles 54 in turn to gradually apply an even or balanced compressive force around the subsea well installation 10. In this example, the turnbuckles 54 each include a tension monitor in the form of a strain gauge 55 for indicating a level of tension in at least one of the cables 48 so that the installer/operator can determine whether the tension in the cables 48 is appropriate for providing the even or balanced compressive force through the Xmas tree 12. It will be appreciated that any part of the tension arrangement 34 may include at least one tension monitor. For example, at least one of: the tension support members 44; the cables 48; and any other part of the tension arrangement 34 may include at least one tension monitor in addition to or instead of the tension monitors in the turnbuckles 54 of the present example.

The subsea well installation 10 may include a tension control system (not shown) for monitoring the tension in the cables 48 during installation of the FACT adaptor 24 and/or during a well operation. An installer/operator may use the tension control system to evaluate how best to carry out the installation of the tension arrangement 34 or well operation in such a manner that avoids or reduces the risk of damage occurring to the Xmas tree 12 or any other components. It will be appreciated that monitoring tension in at least one of the cables 48 may also provide an indication of the loading experienced by the Xmas tree 12. For example, a higher tension measured on one side of the Xmas tree 12 may be indicative of an adverse bending moment being experienced by the Xmas tree 12. By monitoring the tension in at least one the cables 48, it may be possible to determine information relating to the loading in the Xmas tree 12, which may be used to suspend, alter or otherwise change the way in which an operation is being carried out to control or reduce the loading in the Xmas tree 12, and/or the operate may change the tension in at least one cable 48 to control or reduce the loading in the Xmas tree 12.

Figure 2:
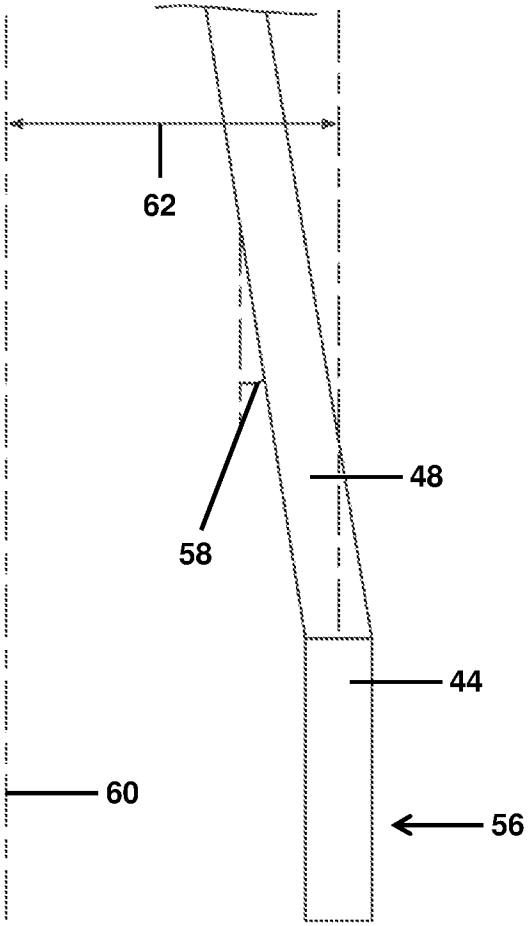
FIG. 2 is a side view of a component for supporting the tension arrangement according to an example of the present disclosure.

FIG. 2 illustrates a bracket 56 including one of the tension support members 44 of the second mounting arrangement 42. Although not illustrated, the bracket 56 can be attached to e.g. the guide frame 30 illustrated by FIG. 1. Also illustrated in FIG. 2 is part of the cable 48 which extends towards one of the pad eyes 38 (not shown in this Figure) at a first angle 58, the first angle 58 being defined between a vertical direction 60 defined by the Xmas tree 12 and cable 48. The bracket 56 is spaced apart from the Xmas tree 12 by a first distance 62. The first angle 58 is relatively small by virtue of the ratio of the first distance 62 to the distance between the first and second mounting arrangements 36, 42 being relatively small. Therefore, once the cable 48 applies a tension through the Xmas tree 12, there will be a relatively large component of tension vertically in the cable 48, i.e. parallel to the vertical direction 60 compared with a relatively small component of tension acting in a horizontal direction, i.e. perpendicular to the vertical direction 60, such that the cable 48 will be less resistant to horizontal movement of the Xmas tree 12 (e.g. via bending loads, and the like).

Figure 3:
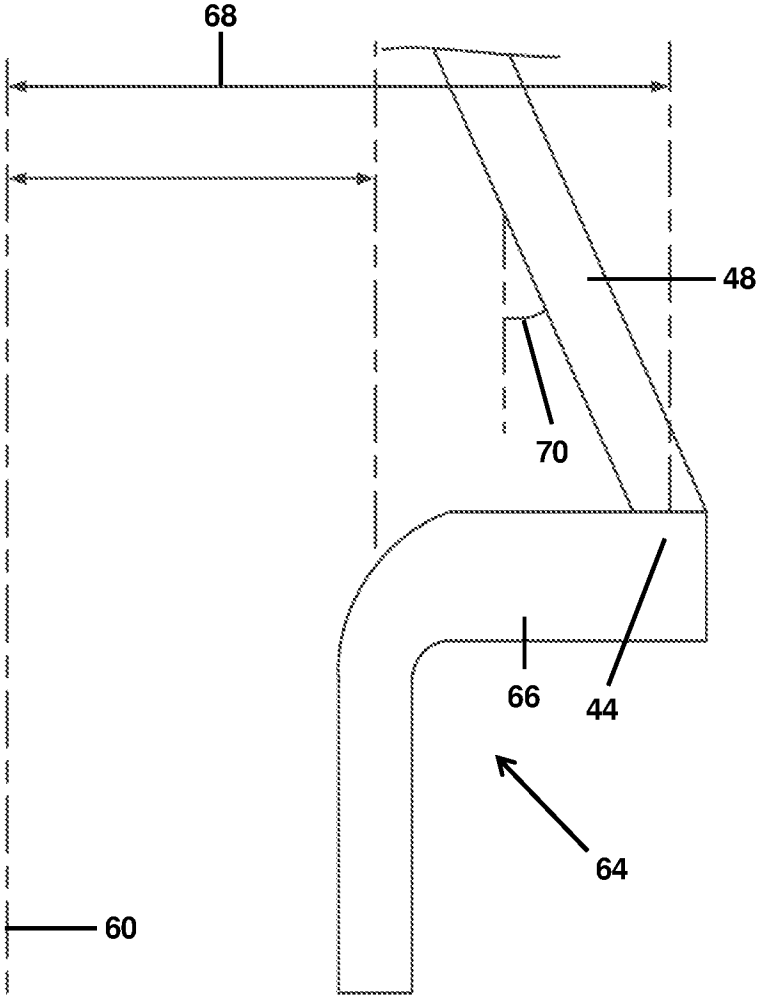
FIG. 3 is a side view of a component for supporting the tension arrangement according to a further example of the present disclosure.

In contrast to FIG. 2, FIG. 3 illustrates an extended bracket 64 for increasing the resistance to horizontal (e.g. bending, or the like) movement of the Xmas tree 12. Although not illustrated, the extended bracket 64 can be attached to e.g. the guide frame 30 illustrated by FIG. 1. The tension support member 44 of the extended bracket 64 is mounted at the end of a horizontally extending arm 66 of the extended bracket 64 so that a second distance 68 is defined between the tension support member 44 and the Xmas tree 12 where the second distance 68 is greater than the first distance 62 so as to define a second angle 70, the second angle 70 being defined between the vertical direction 60 defined by the Xmas tree 12 and cable 48. The distance (e.g. the height) between the first and second mounting arrangements 36, 42 is the same for FIGS. 2 and 3. Therefore, in contrast to the example of FIG. 2, the extended bracket 64 of FIG. 3 provides a relatively smaller component of tension vertically in the cable 48 (e.g. due to having a relative larger (second) angle 70 than the first angle 58) compared with a relatively larger component of tension acting in the horizontal direction such that the cable 48 will be more resistant to horizontal movement of the Xmas tree 12 (e.g. via bending loads, and the like). However, due to the decreased component of tension acting in the vertical direction (e.g. due to having a relative larger (second) angle 70 than the first angle 58), the compressive force acting through the Xmas tree 12 may be smaller than in the example of FIG. 2 such that the tension arrangement 34 of FIG. 3 may be less resistant to vertical separation forces, e.g. jarring movements, and the like. In either case (e.g. FIG. 1, 2 or 3), the tension arrangement 34 provides support for the subsea well installation 10 and may assist in maintaining structural integrity of the installation 10 during an intervention or P&A operation, or the like.

Although the present disclosure describes aspects or examples of subsea well installations and associated methods for supporting older Xmas trees and/or wellhead systems, the person of ordinary skill in the art will appreciate that at least one feature of or any of the principles of the present disclosure may be equally applicable to or for use in connection with any wellhead and/or Xmas tree system, including newer wellhead and/or Xmas tree systems.

Although at least one example of the base structure is in the form of the guide frame 30, it will be appreciated that the base structure could take any appropriate form and be locatable or mountable in any appropriate way relative to the wellhead 14 and/or Xmas tree 12. The base structure may be mountable on at least one of: the Xmas tree 12; the guide frame 30; and the wellhead 14. The base structure may be mountable on any other infrastructure associated with the subsea well installation 10, or indeed, on the seabed 16.

It will also be appreciated that the compressive force may be applied through the Xmas tree 12 via any appropriate configuration of the tension arrangement 34, which may extend between a subsea package such as the FACT adaptor 24 and/or an adaptor sub 40 for connecting the subsea package to the Xmas tree 12, and the base structure such as the guide frame 30.

Although at least one example refers to the use of a FACT adaptor 24 as an example of a subsea package, it will be appreciated that any other subsea package may be used, for example, a subsea package comprising an auxiliary tree block, or the like.

The tension support members 44 in this example are provided as separate components mounted to the guide frame 30 during installation of the tension arrangement 34. However, it will be appreciated that the tension support members 44 could form an integral part of the guide frame 30, or indeed be integral with any other component for mounting the second mounting arrangement 42.

What is claimed is:

1. A subsea well installation, comprising:

an Xmas tree coupled to a wellhead;

a base structure located at a lower region of the Xmas tree, wherein the base structure is supported relative to a seabed by the wellhead and is disposed above the seabed;

a subsea package mounted on an upper region of the Xmas tree; and a tension arrangement extending between the base structure and the subsea package, to apply a compressive force through the Xmas tree;

wherein the Xmas tree defines an axial length between the base structure and the subsea package, the tension arrangement extending across at least that axial length, to apply the compressive force through the axial length of the Xmas tree.

2. The subsea well installation of claim 1, wherein the tension arrangement comprises at least one tensioning member extending across at least the axial length.

3. The subsea well installation of claim 1, wherein at least one of:

the base structure is mounted to the wellhead, and the base structure is mounted to, and supported relative to the seabed by, the wellhead itself such that a part of the tension arrangement associated with the base structure is fixed relative to the wellhead.

4. The subsea well installation of claim 1, wherein the tension arrangement comprises at least one tensioning member, and wherein the at least one tensioning member extends between the subsea package and the base structure.

5. The subsea well installation of 1, comprising a tension monitor for monitoring tension or loading in at least one of: the tension arrangement; and the Xmas tree.

6. A subsea well installation, comprising:

an Xmas tree coupled to a wellhead;

a base structure located at a lower region of the Xmas tree, wherein the base structure is supported relative to a seabed by the wellhead;

a subsea package mounted on an upper region of the Xmas tree; and a tension arrangement extending between the base structure and the subsea package, to apply a compressive force through the Xmas tree;

wherein the Xmas tree defines an axial length between the base structure and the subsea package, the tension arrangement extending across at least that axial length, to apply the compressive force through the axial length of the Xmas tree; and a first mounting arrangement for connecting the tension arrangement to the upper region of the Xmas tree and a second mounting arrangement for connecting the tension arrangement to the lower region of the Xmas tree.

7. The subsea well installation of claim 6, wherein at least one of:

the first mounting arrangement is axially proximal to the subsea package and axially distal to the wellhead; and the first mounting arrangement is connectable to or provided as part of the subsea package, and wherein the second mounting arrangement is axially proximal to the wellhead and axially distal to the subsea package.

8. The subsea well installation of claim 6, wherein the first mounting arrangement is connectable to or provided as part of an adaptor sub or interface sub provided as part of or connectable to the subsea package.

9. The subsea well installation of claim 6, wherein the second mounting arrangement is connectable to or provided as part of the base structure.

10. A method for supporting a subsea well installation, the subsea well installation comprising an Xmas tree coupled to a wellhead and a base structure located at a lower region of the Xmas tree, the method comprising:

providing a tension arrangement between the base structure and a subsea package mounted on an upper region of the Xmas tree, wherein the base structure is supported relative to a seabed by the wellhead and is disposed above the seabed; and applying a compressive force through an axial length of the Xmas tree extending between the base structure and the subsea package using the tension arrangement to apply tension between the base structure and the subsea package.

11. The method of claim 10, wherein the tension arrangement comprises at least one tensioning member extending between the subsea package and the base structure.

12. The method of claim 11, comprising controlling or varying tension in the tension arrangement to control compressive force applied through the Xmas tree.

13. The method of claim 10, comprising monitoring tension or loading in at least one of the tension arrangement or the Xmas tree, and determining the compressive force acting through the Xmas tree using the monitored tension or loading.

14. The method of claim 13, comprising varying tension in the tension arrangement in response to a tension value registered during monitoring of the tension or loading in the at least one of the tension arrangement or the Xmas tree.

15. The method of claim 13, comprising controlling movement of the subsea package relative to the Xmas tree in response to a tension value registered during the monitoring of the tension or loading in the at least one of the tension arrangement or the Xmas tree.

16. The method of claim 10, further comprising performing an operation on a well that is accessible via the wellhead, wherein the operation comprises at least one of: a completion; production; intervention; or plugging and abandonment operation.

* * * * *